US008066404B2

(12) United States Patent
Song et al.

(10) Patent No.: US 8,066,404 B2
(45) Date of Patent: Nov. 29, 2011

(54) LED LAMP

(75) Inventors: Guang Song, Shenzhen (CN); You-Xue Liu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 264 days.

(21) Appl. No.: 12/604,410

(22) Filed: Oct. 23, 2009

(65) Prior Publication Data

US 2011/0002120 A1 Jan. 6, 2011

(30) Foreign Application Priority Data

Jul. 3, 2009 (CN) ..... 2009 1 0303973

(51) Int. Cl.
*F21S 4/00* (2006.01)

(52) U.S. Cl. ... 362/219; 362/218; 362/294; 362/249.02; 362/396; 257/722

(58) Field of Classification Search ..... 362/217, 362/218, 294, 373, 547, 249.02, 249.03, 362/249.11, 396; 257/722
See application file for complete search history.

(56) References Cited

U.S. PATENT DOCUMENTS

| | | | | |
|---|---|---|---|---|
| 7,857,486 | B2 * | 12/2010 | Long et al. | 362/294 |
| 7,887,216 | B2 * | 2/2011 | Patrick | 362/218 |
| 7,891,845 | B2 * | 2/2011 | Zhang et al. | 362/294 |
| 2008/0062694 | A1 * | 3/2008 | Lai et al. | 362/294 |
| 2009/0086488 | A1 * | 4/2009 | Lynch et al. | 362/249.02 |
| 2009/0168417 | A1 * | 7/2009 | Zhang et al. | 362/234 |
| 2009/0268476 | A1 * | 10/2009 | Zhou et al. | 362/373 |
| 2009/0303717 | A1 * | 12/2009 | Long et al. | 362/249.02 |
| 2011/0090682 | A1 * | 4/2011 | Zheng et al. | 362/218 |

* cited by examiner

*Primary Examiner* — Ali Alavi
(74) *Attorney, Agent, or Firm* — Altis Law Group, Inc.

(57) ABSTRACT

An LED lamp includes a plurality of LED light units juxtaposed together and a connecting member engaging with the LED light units. Each LED light unit includes a heat sink and an LED module engaged on the heat sink. The heat sink defines a groove group at each lateral portion thereof. The connecting member includes a plurality of inserts received in grooves of the groove groups of the heat sinks of neighboring LED light units and clasping the neighboring LED light units together thereby to secure the LED light units into the LED lamp.

15 Claims, 7 Drawing Sheets

LED LAMP

BACKGROUND

1. Technical Field

The present disclosure relates to an LED (light emitting diode) lamp and, more particularly, to an LED lamp using a plurality of juxtaposed LED light units for various illuminating requirements.

2. Description of Related Art

An LED lamp utilizing LEDs as a source of illumination is widely used in many fields because the LEDs have features of long-term reliability, environment friendliness and low power consumption. It is well-known that a conventional grille lamp utilizes fluorescent lights as a source of illumination. With the development of the LED lamp, the LED lamp is intended to be a cost-effective yet high quality replacement for the conventional grille lamp.

Generally, the LED lamp comprises a bracket integrally formed via a die and a plurality of LED modules received in the bracket. The LED lamp can achieve a fixed illumination intensity because a dimension of the bracket is fixed. For achieving different illumination intensities according to different needs, the dimension of the bracket has to be changed. However, a change of the die for forming the bracket raises a considerable cost burden. Furthermore, to have different dies with different sizes requires a high manufacture, inventory and material cost.

What is needed, therefore, is an LED lamp whose light intensity can be easily adjusted by increasing or decreasing the number of LEDs thereof for meeting different illumination demands.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
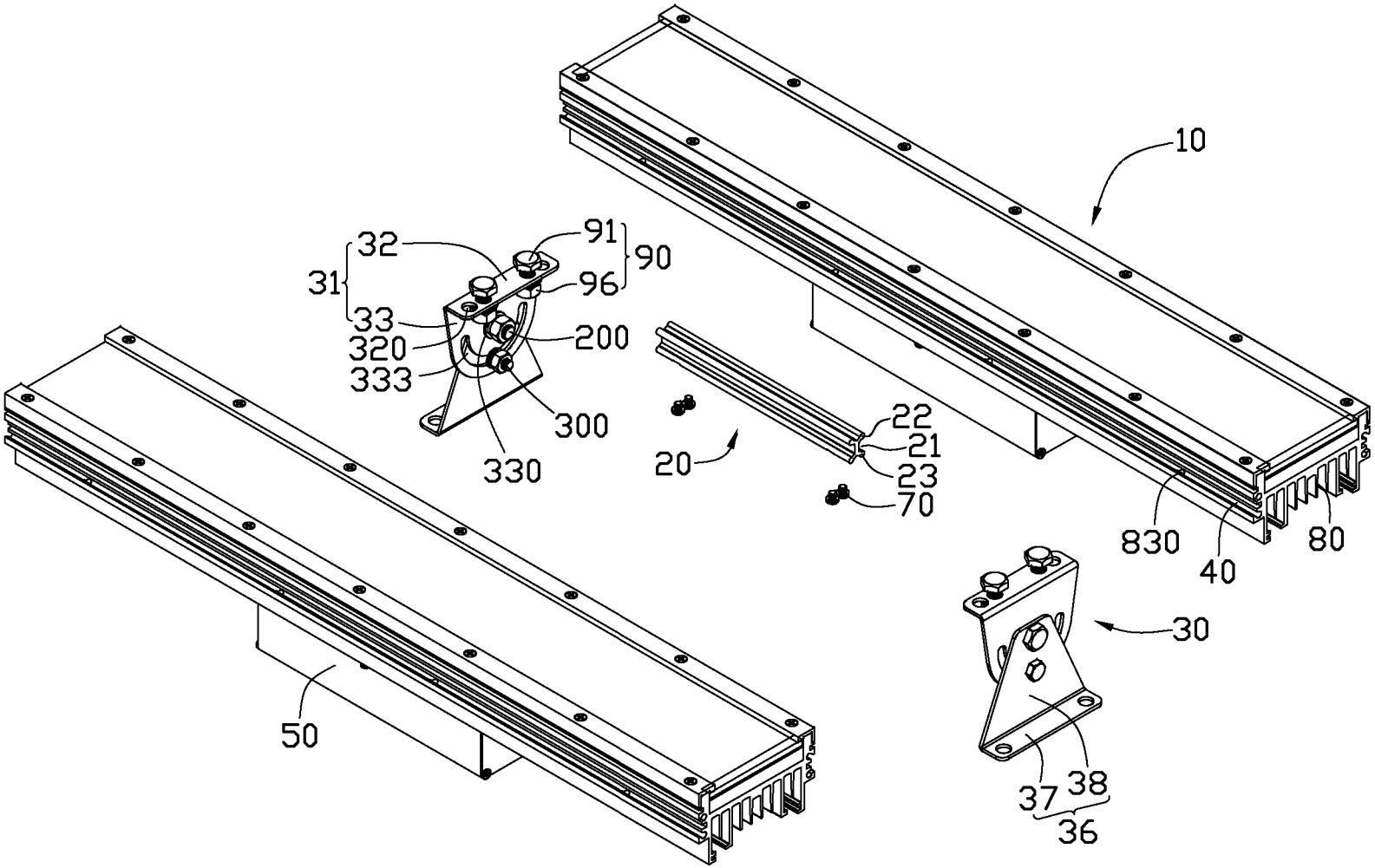
FIG. 1 is an isometric, exploded view of an LED lamp in accordance with a first embodiment of the disclosure.
Figure 2:
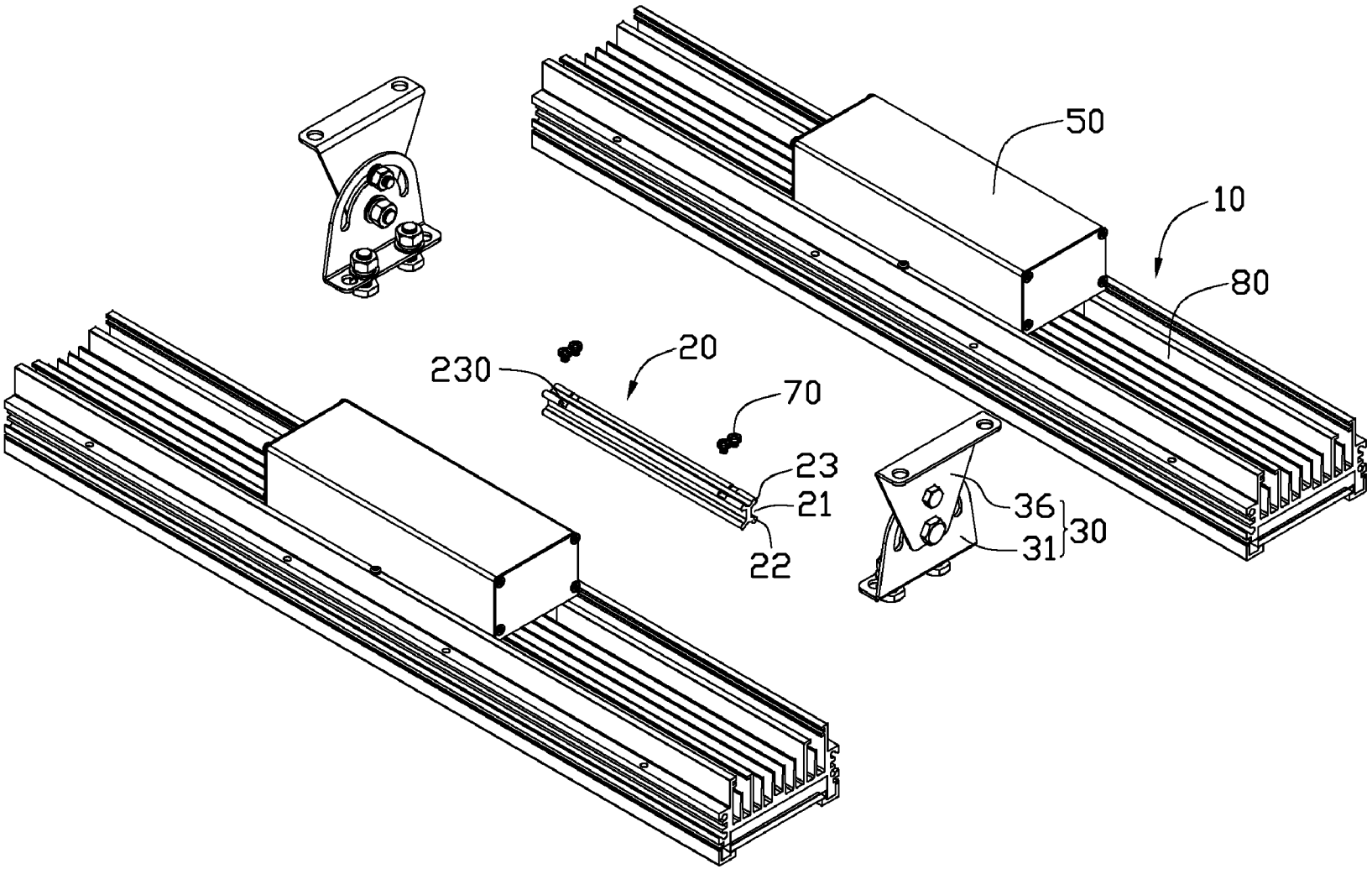
FIG. 2 is an inverted view of the LED lamp of FIG. 1.

Referring to FIGS. 1-2, an LED lamp in accordance with a first embodiment of the disclosure is illustrated. The LED lamp can be used as a washing wall lamp, a tunnel lamp, and so on. The LED lamp comprises two LED light units 10 juxtaposed with each other, a connecting member 20 connecting lateral portions of the light units 10, and two mounting brackets 30 engaged on the light units 10. The LED light units 10 are placed side by side. Each lateral portion of each LED light unit 10 defines a lengthways groove group 40 therein. A bottom of each LED light unit 10 engages with a power module 50.

Figure 3:
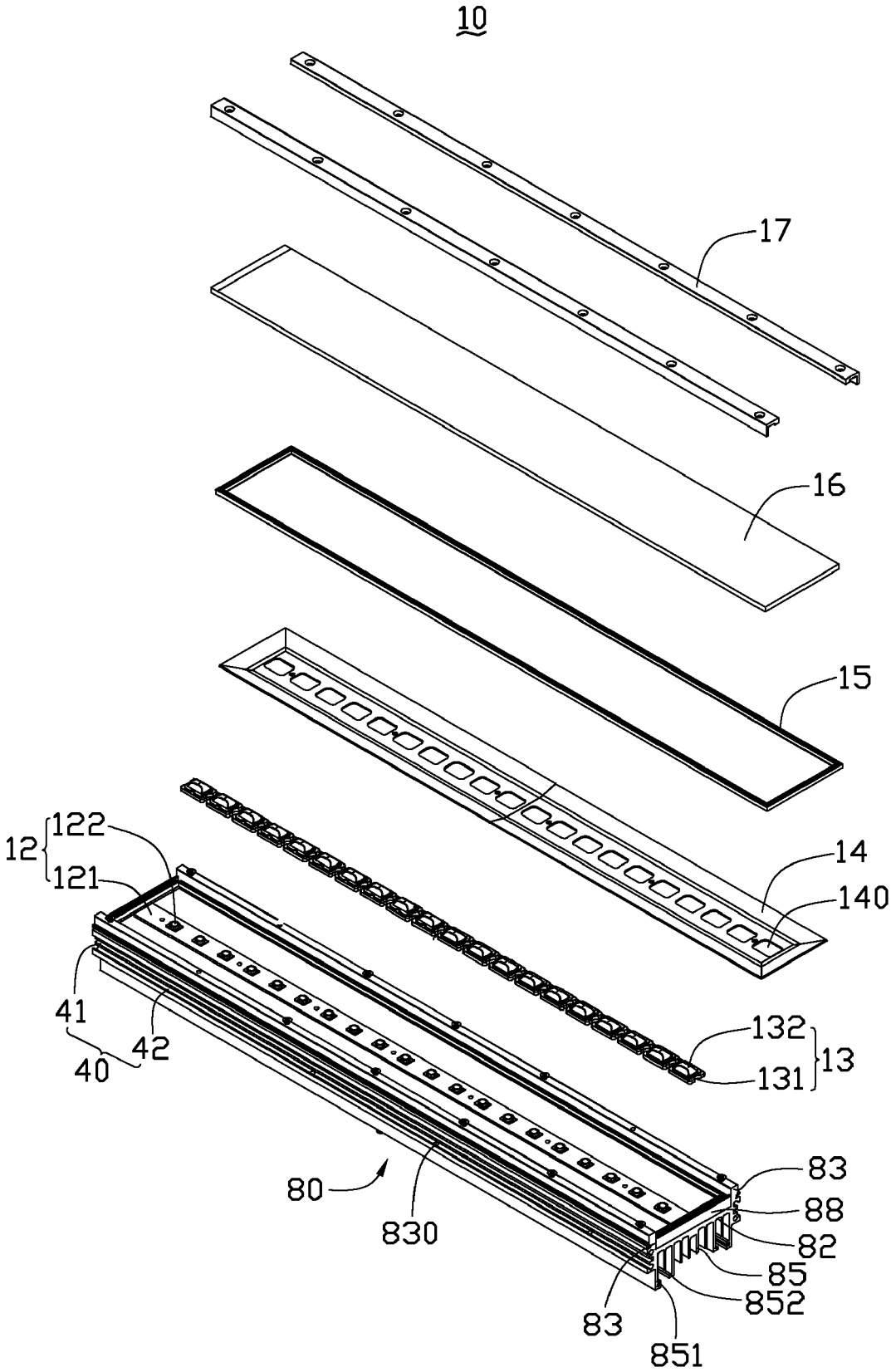
FIG. 3 is an exploded view of an LED light unit of the LED lamp of FIG. 1.
Figure 4:
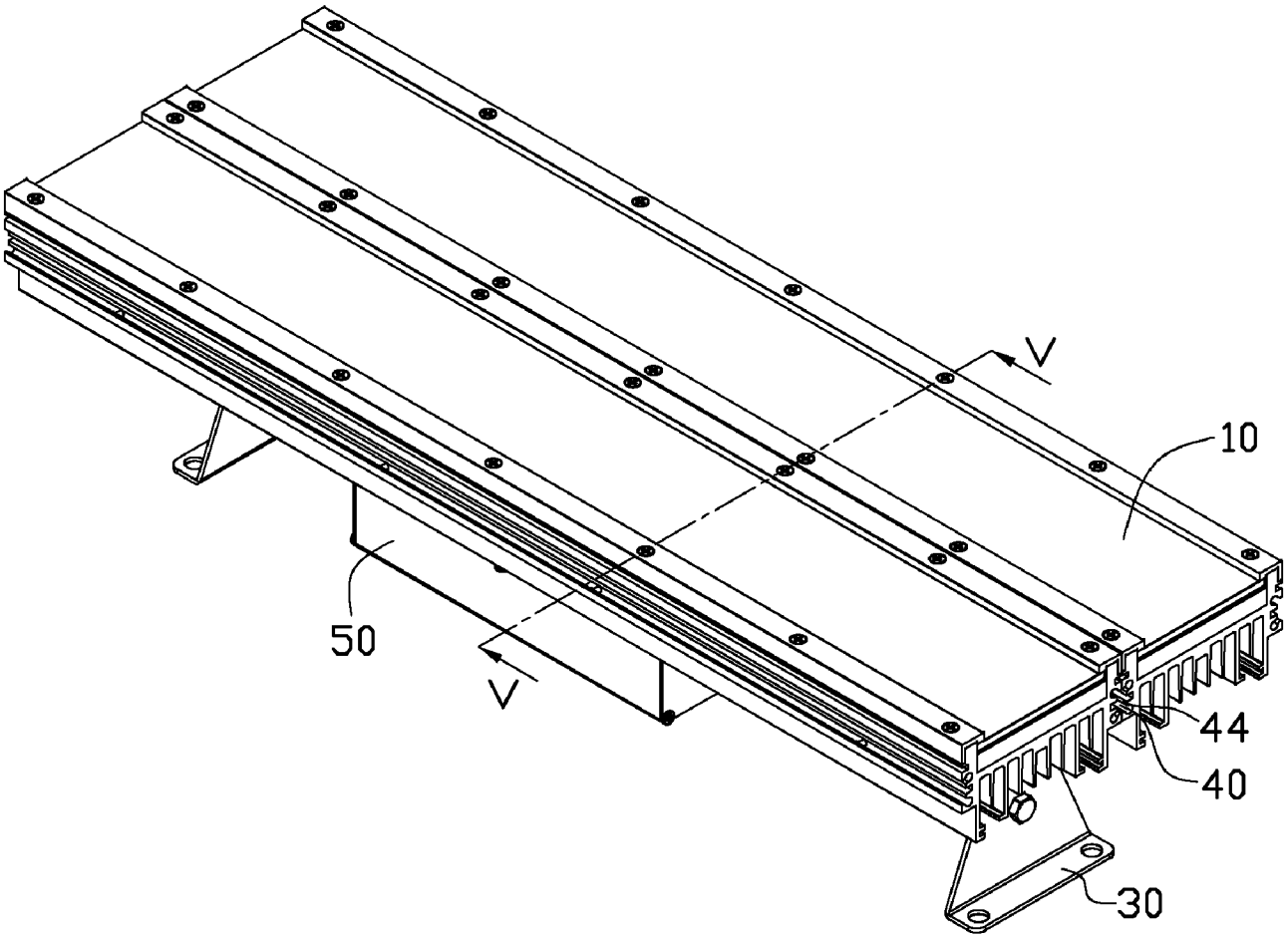
FIG. 4 is an assembled view of the LED lamp of FIG. 1.
Figure 5:
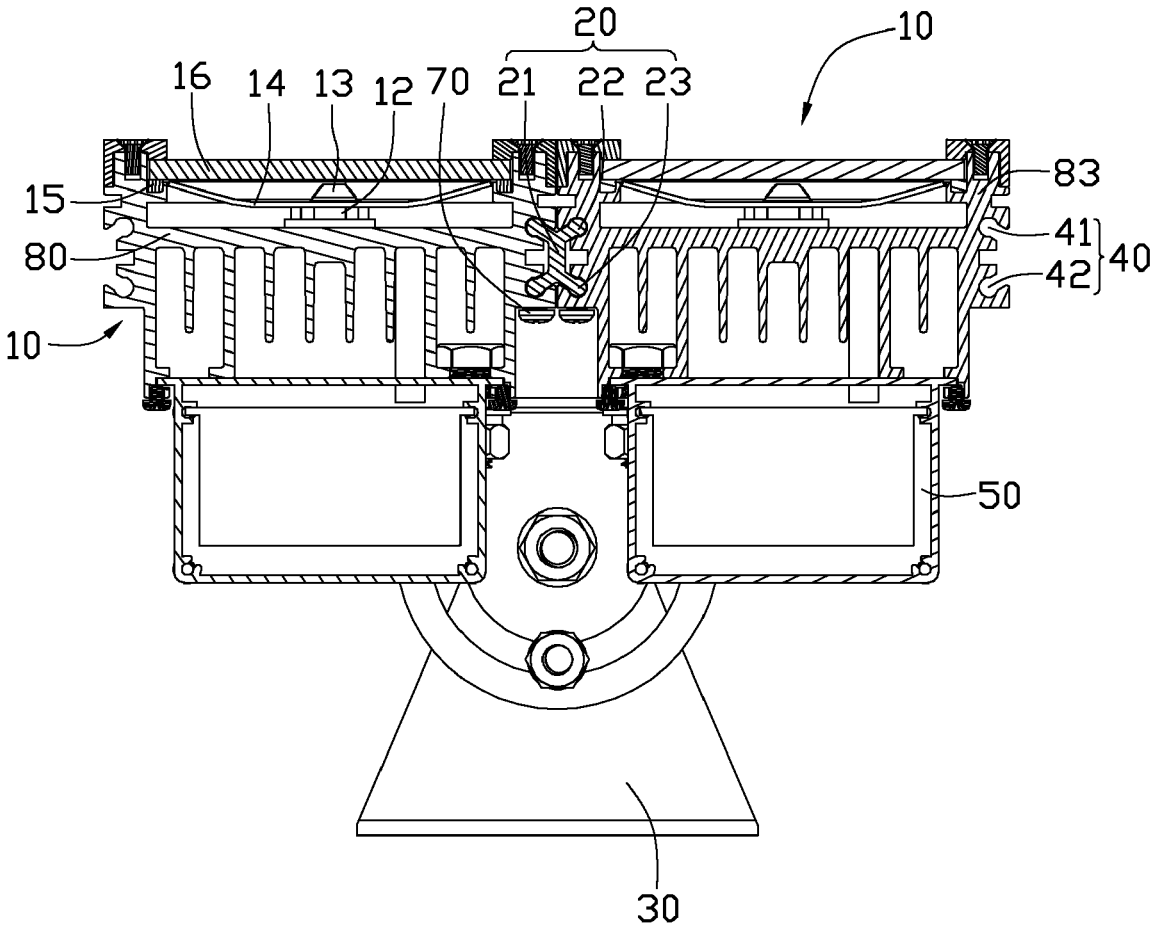
FIG. 5 is a cross-sectional view of the LED lamp of FIG. 4, taken along line V-V thereof.

Also referring to FIGS. 3-5, each light unit 10 comprises a heat sink 80, an LED module 12, a lens module 13 mounted on the LED module 12, a reflector 14 covering the LED module 12 and the lens module 13, a transparent plate 16, and two fixing strips 17 mounting the transparent plate 16 on the heat sink 80.

The heat sink 80 is integrally formed of a metal with a good heat conductivity such as aluminum, copper or an alloy thereof. In this embodiment, the heat sink 80 is made of aluminum extrusion and is extruded along a lengthways direction from a first end to a second end thereof; thus, the heat sink 80 can be manufactured into different lengths by severing an extruded semi-finished product, without the necessity of redesigning a mould/die. The heat sink 80 comprises a heat spreader 82, two walls 83 extending upwardly and downwardly from two lateral edges of the heat spreader 82, and a plurality of fins 85 extending downwardly from a bottom surface of the heat spreader 82. The fins 85 are parallel to and sandwiched between lower portions of the walls 83 below the heat spreader 82.

Each of the walls 83 defines the groove group 40 at a lateral surface thereof. In this embodiment, the groove group 40 comprises a first groove 41 and a second groove 42 below the first groove 41. Referring to FIG. 5, the first groove 41 and the second groove 42 are inclined to each other. Particularly the first groove 41 is defined outwardly and downwardly, and the second groove 42 is defined outwardly and upwardly, whereby the first and second grooves 41, 42 are opened laterally toward each other. Each wall 83 defines a plurality of screw locating holes 830 at bottom thereof. The screw locating holes 830 communicate with the second groove 42. Each of two outmost fins 85 extends two parallel shoulders 851 inwardly from a lower portion thereof, whereby each outmost fin 85 has an inverted F-shaped configuration. An engaging portion 852 extends outwardly from a bottom of one of the fins 85 neighboring a corresponding outmost fin 85 and faces the shoulders 851 of the corresponding outmost fin 85. The engaging portions 852 cooperate with the shoulders 851 for securing the mounting brackets 30 to the light units 10.

The LED module 12 includes an elongated printed circuit board 121, and a plurality of LEDs 122 mounted on the printed circuit board 121 and arrayed in a line. The lens module 13 is elongated and includes a base 131 and a plurality of lenses 132 protruding upwardly from the base 131. The lenses 132 have an amount equal to that of the LEDs 122. The lens module 13 is made of a transparent material, such as epoxy resin, polymethyl methacrylate (PMMA), and so on. Each lens 132 defines a cavity (not shown) at a bottom thereof for receiving a corresponding LED 122 therein. An outer, peripheral portion (not labeled) of the reflector 14 is concave to reflect light generated by the LEDs 122. A central area of the reflector 14 is plate-like and defines a plurality of openings 140. The reflector 14 abuts against the bases 131 of the lens module 13 with the lenses 132 extending through the openings 140 of the reflector 14, respectively.

In assembly of each LED lamp unit 10, the LED module 12 is mounted on a top of the heat spreader 82. The lens module 13 and the reflector 14 are mounted on the LED module 12. Two blocks 88 are mounted on the first and second ends of the heat sink 80, respectively. In this embodiment, the blocks 88 are made of aluminum and welded to the heat sink 80. The blocks 88 and upper portions of the walls 83 above the heat spreader 82 cooperatively define a rectangular groove (not labeled) at tops thereof to receive a rectangular waterproof gasket 15 therein. The transparent plate 16 is mounted on the waterproof gasket 15. Finally, the fixing strips 17 are mounted on tops of walls 83 and press the transparent plate 16 downwardly. Each power module 50 is mounted on a bottom of the fins 85 of each heat sink 80.

The connecting member 20 is formed of material with a high strength such as aluminum. The connecting member 20 is elongated and has an X-shaped cross section. In this embodiment, the connecting member 20 is shorter than the heat sink 80. The connecting member 20 comprises a middle portion 21, two first inserts 22 extending outwardly and upwardly from a top of the middle portion 21, and two second inserts 23 extending outwardly and downwardly from a bottom of the middle portion 21. Each of the first inserts 22 has a cross section similar to that of the first groove 41 in the wall 83, and each of the second inserts 23 has a cross section similar to that of the second groove 42; thus, the first and second inserts 22, 23 can fitly engage in the first and second grooves 41, 42, respectively. Each of the first and second inserts 22, 23 has an outer end thicker than an inner end near the middle portion 21. Each of the second inserts 23 defines a plurality of notches 230 in a bottom thereof (best see FIG. 2) corresponding to the screw locating holes 830 of the heat sink 80.

Each of the mounting brackets 30 comprises a first fixing member 31 mounted on the LED lamp and a second fixing member 36 pivotally engaged with the first fixing member 31. Each of the first and second fixing members 31, 36 is an L-shaped piece made of a metal plate. The first fixing member 31 includes a first mounting portion 32 and a first pivotal portion 33 extending perpendicularly from an edge of the first mounting portion 32. The first mounting portion 32 defines four spaced though holes 320. Two fasteners 90 engage in middle two of the through holes 320. Each of the fasteners 90 comprises a bolt 91 extending in the through hole 320 and a nut 96 for engaging a bottom end of the bolt 91. The bolt 91 has a polygonal head sandwiched between the outmost fin 85 having the shoulders 851 and the neighboring fin 85 having the engaging portion 852, at a position above the shoulders 851 and the engaging portion 852 (best seen FIG. 5). A distance between the outmost fin 85 and the neighboring fin 85 is the same or slightly larger than a width between two opposite sides of the polygonal head of the bolt 91, and smaller than a distance between two opposite corners of the polygonal head of the bolt 91; thus, the bolt 91 can not be rotated relative to the fins 85 when the polygonal head thereof is received between the two corresponding fins 85. The first pivotal portion 33 defines a central hole 330 and a semicircular slot 333 around the central hole 330.

Each of the second fixing members 36 has a second mounting portion 37 and a second pivotal portion 38 extending perpendicularly from an edge of the second mounting portion 37. A second fastener 200 extends through the second pivotal portion 38 and the central hole 330 of the first pivotal portion 33. When the first fixing member 31 rotates around the second fixing member at a proper angle, a third fastener 300 extends through the second pivotal portion 38 and the slot 333 of the first pivotal portion 33. Thus, the LED lamp units 10 mounted on the first fixing member 31 can rotate around the second fixing member 36 to adjust an illumination angle of the LED lamp units 10 relative to a base (not shown) on which the LED lamp is mounted. Here the base can be a ceiling, a wall or a floor.

In assembly of the LED lamp, the LED lamp units 10 are juxtaposed with each other. The walls 83 of the heat sinks 80 of the LED lamp units 10 contact each other and the first and second grooves 41, 42 of the LED lamp units 10 form a channel 44 which has an X-shaped cross-section corresponding to the cross-section of the connecting member 20. The connecting member 20 is inserted into the channel 44 defined by the first and second grooves 41, 42 and clasps the walls 83 of the heat sinks 80. The connecting member 20 slides in the channel 44 and located at a position where the notches 230 of the connecting member 20 face the locating holes 830 of the heat sinks 80. A plurality of fixing members 70, such as screws, extends through in the screw locating holes 830 and engages in the notches 230 thereby to prevent the connecting member 20 from sliding in the channel 44. Alternatively, the fixing members 70 can be rivets, or omitted by welding the connecting member 20 and the heat sinks 80 together. An amount of the connecting member 20 can be changed in view of a length of the heat sinks 80 and an assembling strength requirement; for example, the amount of the connecting member 20 can be two. The cross section of the connecting member 20 can be designed to other shapes, such as H-like shape, or W-like shape, and so on, when the shape of the cross section of the channel 44 defined by the groove group 40 is changed correspondingly. Finally, the mounting brackets 30 are mounted on the heat sinks 80 by tightening the nuts 96, whereby the first mounting portions 32 of the first fixing members 31 of the brackets 30 are securely sandwiched between the shoulders 851 of the adjacent outmost fins 85 of the two heat sinks 80 and the nuts 96.

Figure 6:
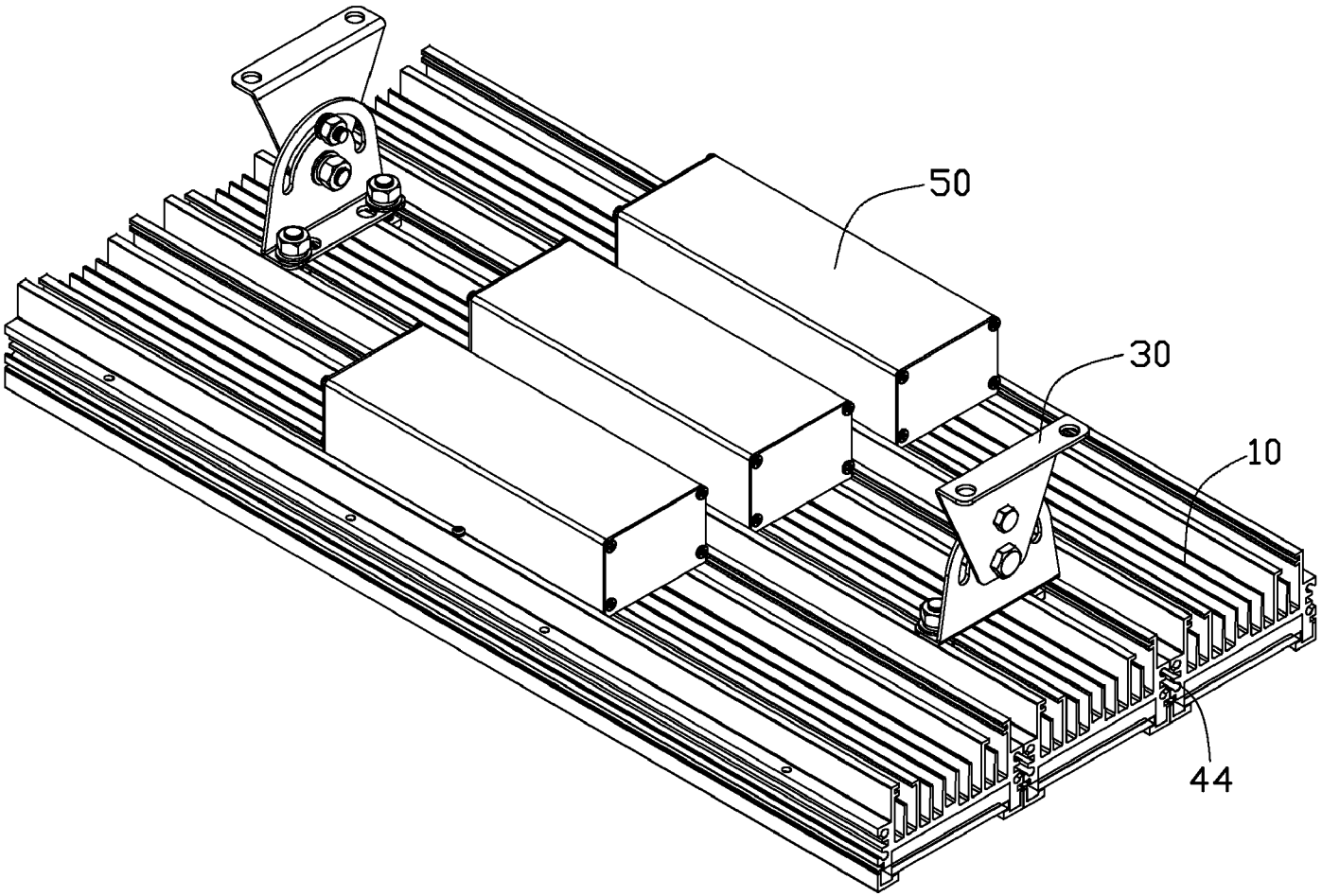
FIG. 6 is an assembled view of an LED lamp in accordance with a second embodiment of the disclosure.

Referring to FIG. 6, an LED lamp in accordance with a second embodiment of the disclosure is illustrated. The LED lamp comprises three LED light units 10 juxtaposed with each other. Each of the LED lamp units 10 has the same configuration as the LED lamp unit 10 of the first embodiment. Two neighboring LED lamp units 10 are connected together by a connecting member (not shown) which is the same as the connecting member 20 of the first embodiment. Different from the brackets 30 of the first embodiment which engage with the fins 85 of the two heat sinks 80 of the two LED units 10, the brackets 30 of the second embodiment engage at two ends of the fins 85 of the heat sink 80 of a middle one of the LED lamp units 10. In this embodiment, the fasteners 90 are engaged in the outer two of the four through holes 320 of the first fixing member 32.

Figure 7:
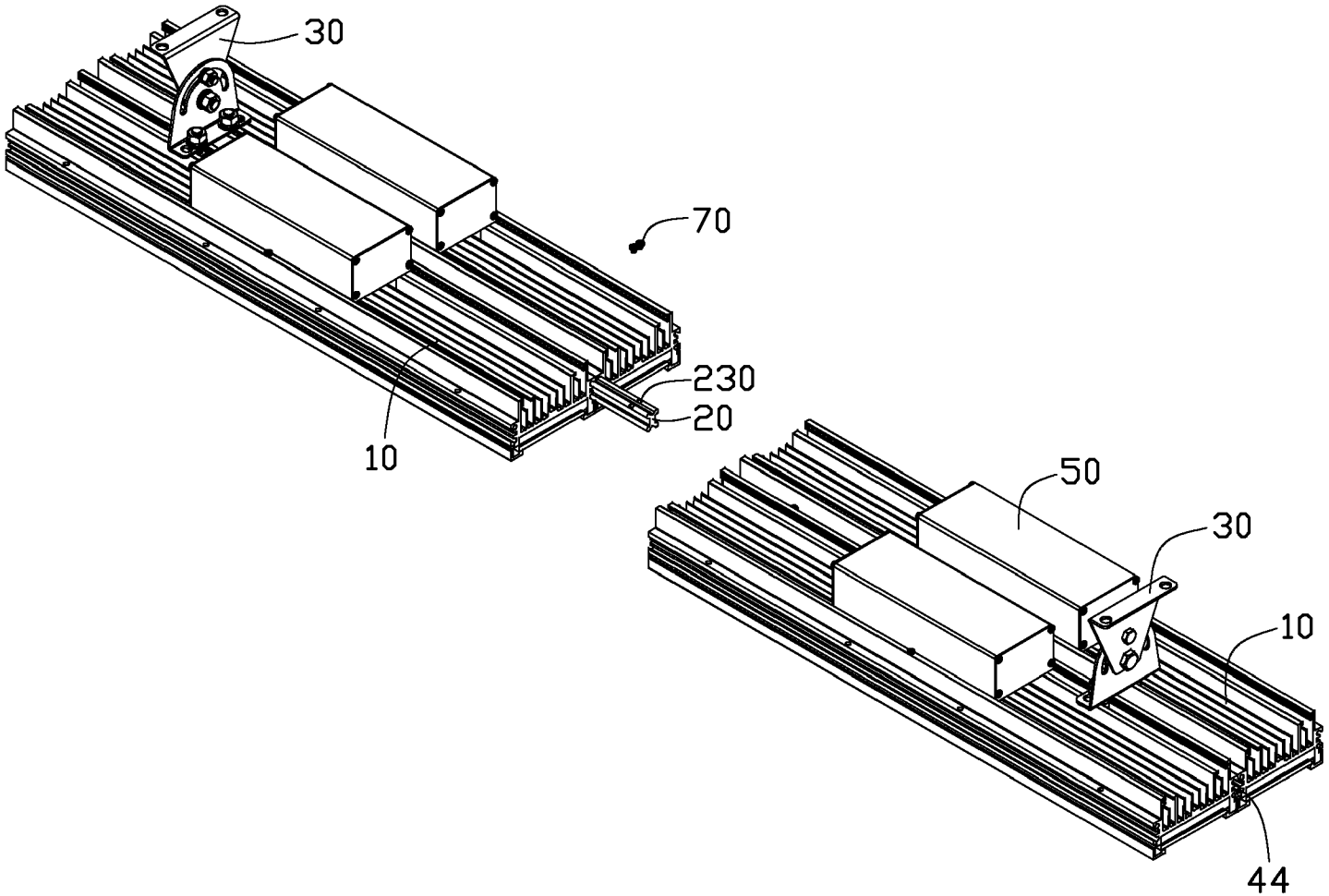
FIG. 7 is an isometric, exploded view of an LED lamp in accordance with a third embodiment of the disclosure.

Referring to FIG. 7, an LED lamp in accordance with a third embodiment of the disclosure is illustrated. The LED lamp consists of two LED lamps of the first embodiment which are placed end-to-end; in other words, the LED lamp of the third embodiment comprises four LED lamp units 10 arranged in a matrix. Two connecting members 20 each secure each two neighboring LED lamp units 10 along the transversal direction; thereafter, a middle connecting member 20 connects the four LED lamp units 10 together along the lengthwise direction. The middle connecting member 20 has a part received in a channel 44 defined by two LED lamp units 10 connected together along the transverse direction and another part received in another channel 44 defined by the other two LED lamp units 10 connected together along the transverse direction. A plurality of screws 70 engages the LED lamp units 10 and the middle connecting member 20 thereby to assemble the LED lamp.

Since an amount of the LED light units 10 and a combination of the LED light units 10 and the connecting members 20 can be changed, a lengthways length and a transverse width of the LED lamp can be changed for various illuminating requirements. The size of the LED lamp in accordance with the present disclosure can be changed without requiring a new mould/die. Thus, the cost for manufacturing the LED lamp can be considerably reduced.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp, comprising:

a plurality of LED light units juxtaposed together, each LED light unit comprising a heat sink and an LED module engaged on the heat sink, the heat sink defining a groove group at a lateral portion thereof; and a connecting member comprising a plurality of inserts received in the groove groups of the heat sinks of neighboring ones of the LED light units and clasping the neighboring ones of the LED light units together thereby to secure the LED light units into the LED lamp.

2. The LED lamp as claimed in claim 1, wherein the groove groups of the neighboring ones of the LED lamp units form a channel receiving the connecting member therein, the channel having a cross-section corresponding to a cross-section of the connecting member.

3. The LED lamp as claimed in claim 2, wherein the connecting member comprises a middle portion, the inserts extending from two sides of the middle portion.

4. The LED lamp as claimed in claim 3, wherein the inserts each have an outer end thicker than an inner end near the middle portion.

5. The LED lamp as claimed in claim 2, wherein an amount of the inserts is four, and the cross-section of the connecting member is X-shaped.

6. The LED lamp as claimed in claim 5, wherein the groove group of the heat sink has a first groove and a second groove spaced from the first groove, the first and second grooves receiving the inserts of the connecting member.

7. The LED lamp as claimed in claim 1, wherein the heat sink of each LED light unit is made of aluminum extrusion and is extruded along a direction from one end to another end of the heat sink.

8. The LED lamp as claimed in claim 1, wherein the inserts of the connecting member define a plurality of notches therein, a plurality of fixing members mounted on the heat sinks and engaged into the notches to prevent the connecting member from sliding in the groove groups.

9. The LED lamp as claimed in claim 1, wherein the LED light units are juxtaposed in a in a matrix.

10. The LED lamp as claimed in claim 1, wherein the heat sink is made of metal extrusion and comprises a heat spreader and two walls extending from two lateral edges of the heat spreader, each wall defining the groove groups along the extruded direction of the heat sink to receive the connecting member.

11. The LED lamp as claimed in claim 10, wherein the heat sink further comprises two aluminous blocks welded at opposite ends of the heat sink to enclose the LED module.

12. The LED lamp as claimed in claim 11, wherein the blocks and the walls of each heat sink cooperatively define a groove at a top thereof for receiving a waterproof gasket.

13. An LED (light emitting diode) lamp, comprising:

a plurality of LED light units connected together, each of the LED light units defining at least a groove at each side thereof, the grooves of neighboring ones of the LED lamp units cooperatively form a channel; and a connecting member received in the channel of the neighboring ones of the LED light units and clasping the neighboring ones of the LED light units together thereby to secure the LED light units together to form the LED lamp.

14. The LED lamp as claimed in claim 13, wherein the channel has a cross-section the same as a cross-section of the connecting member.

15. The LED lamp as claimed in claim 13, wherein the connecting member forms a plurality of inserts fittingly inserting into the grooves, and the inserts define a plurality of notches therein, a plurality of fixing members being mounted on the LED lamp units and engaged into the notches to prevent the connecting member from sliding in the channel.

* * * * *